US009099788B2

(12) United States Patent
Liu et al.

(10) Patent No.: US 9,099,788 B2
(45) **Date of Patent: *Aug. 4, 2015**

(54) MAN-MADE COMPOSITE MATERIAL AND MAN-MADE COMPOSITE MATERIAL ANTENNA

(75) Inventors: Ruopeng Liu, Guangdong (CN); Chunlin Ji, Guangdong (CN); Yutao Yue, Guangdong (CN)

(73) Assignees: KUANG-CHI INNOVATIVE TECHNOLOGY LTD., FuTian District, Shenzhen, Guangdong; KUANG-CHI INSTITUTE OF ADVANCED TECHNOLOGY, High-Tech Industrial Estate, Nanshan District, Shenzhem, Guangdong (CN)

( * ) Notice: Subject to any disclaimer, the term of this patent is extended or adjusted under 35 U.S.C. 154(b) by 573 days.

This patent is subject to a terminal disclaimer.

(21) Appl. No.: 13/522,966

(22) PCT Filed: Nov. 24, 2011

(86) PCT No.: PCT/CN2011/082837

§ 371 (c)(1), (2), (4) Date: Jul. 19, 2012

(87) PCT Pub. No.: WO2013/016918

PCT Pub. Date: Feb. 7, 2013

(65) Prior Publication Data

US 2013/0027278 A1 Jan. 31, 2013

(51) Int. Cl.
*H01Q 15/02* (2006.01)
*H01Q 19/06* (2006.01)

(52) U.S. Cl.
CPC ..... *H01Q 19/065* (2013.01); *H01Q 15/02* (2013.01)

(58) Field of Classification Search
CPC ..... H01Q 15/02; H01Q 19/065
USPC ..... 343/753, 909, 757, 761, 782; 250/339.05, 482.1, 503.1; 359/642, 359/620, 321, 341.32, 586, 652
See application file for complete search history.

(56) References Cited

U.S. PATENT DOCUMENTS 5,661,499 A * 8/1997 Epshtein et al. ..... 343/911 R
6,151,168 A * 11/2000 Goering et al. ..... 359/623
2011/0199281 A1* 8/2011 Morton et al. ..... 343/872

* cited by examiner

*Primary Examiner* — Sue A Purvis
*Assistant Examiner* — Jae Kim
(74) *Attorney, Agent, or Firm* — Winston Hsu; Scott Margo

(57) ABSTRACT

The present invention relates to a man-made composite material. The man-made composite material is divided into a plurality of regions. A plane electromagnetic wave is incident on a first surface and exits in the form of a spherical wave from a second surface of the man-made composite material opposite to the first surface. Reverse extensions of the exiting electromagnetic wave intersect with each other at a virtual focus of the man-made composite material. A line connecting the virtual focus to a point on the top surface of the $i^{th}$ region and a line perpendicular to the man-made composite material form an angle θ therebetween, which uniquely corresponds to a curved surface in the $i^{th}$ region. A set formed by points on the top surface of the $i^{th}$ region that have the same angle θ forms a boundary of the curved surface to which the angle θ uniquely corresponds.

20 Claims, 6 Drawing Sheets

MAN-MADE COMPOSITE MATERIAL AND MAN-MADE COMPOSITE MATERIAL ANTENNA

FIELD OF THE INVENTION

The present invention generally relates to the field of electromagnetic technologies, and more particularly, to a man-made composite material and a man-made composite material antenna.

BACKGROUND OF THE INVENTION

In conventional optics, a lens can be used to refract a plane wave into a spherical wave which appears to be radiated from a point light source located at a virtual focus of the lens. Currently, the diverging effect of the lens is achieved by virtue of the refractive property of the spherical form of the lens.

The inventor has found in the process of making this invention that, the lens antenna has at least the following technical problems: the lens is bulky and heavy, which is unfavorable for miniaturization; performances of the lens rely heavily on the shape thereof, and directional propagation from the antenna can be achieved only when the lens has a precise shape; and serious interferences and losses are caused to the electromagnetic wave, which reduces the electromagnetic energy.

Moreover, for most lens antennas, abrupt transitions of the refractive indices follow a simple line that is perpendicular to a lens surface. Consequently, electromagnetic waves propagating through the lenses suffer from considerable refraction, diffraction and reflection, which have a serious effect on the performances of the lenses.

SUMMARY OF THE INVENTION

In view of the aforesaid problems that the prior art antennas suffer from considerable refraction, diffraction and reflection and have poor lens performances, an objective of the present invention is to provide a man-made composite material and a man-made composite material antenna that have superior performances.

To achieve the aforesaid objective, the present invention provides a man-made composite material. The man-made composite material is divided into a plurality of regions. A plane electromagnetic wave is incident on a first surface of the man-made composite material and exits in the form of a spherical wave from a second surface of the man-made composite material opposite to the first surface. Reverse extensions of the exiting electromagnetic wave intersect with each other at a virtual focus of the man-made composite material. An intersection between an $i^{th}$ region and the first surface is a bottom surface of the $i^{th}$ region. An intersection between the $i^{th}$ region and the second surface is a top surface of the $i^{th}$ region. A line connecting the virtual focus to a point on the top surface of the $i^{th}$ region and a line perpendicular to the man-made composite material form an angle θ therebetween, which uniquely corresponds to a curved surface in the $i^{th}$ region. A set formed by points on the top surface of the $i^{th}$ region that have the same angle θ forms a boundary of the curved surface to which the angle θ uniquely corresponds. Each point on the curved surface to which the angle θ uniquely corresponds has a same refractive index. Refractive indices of each of the regions increase gradually as the angle θ increases.

Preferably, a line connecting the virtual focus to a point on an outer circumference of the top surface of the $i^{th}$ region and the line perpendicular to the man-made composite material form an angle $\theta_i$ therebetween, i is a positive integer, and the closer the region is to a center of the man-made composite material, the smaller the value of i will be; wherein a generatrix of a curved surface to which the angle $\theta_i$ corresponds has an arc length $c(\theta_i)$, and the arc length $c(\theta_i)$ and the angle $\theta_i$ satisfy the following equations:

$$c(\theta_i) = \frac{\lambda}{n_{max(i)} - n_{min(i+1)}};$$

$$(s+d)\times\left(\frac{1}{\cos\theta_i} - \frac{1}{\cos\theta_{i-1}}\right) = c(\theta_i)n_{max(i)} - c(\theta_{i-1})n_{min(i)}\Big),$$

where, $\theta_0=0$, $c(\theta_0)=d$; s is a distance from the virtual focus to the man-made composite material; d is a thickness of the man-made composite material; λ is a wavelength of an electromagnetic wave, $n_{max(i)}$ and $n_{min(i)}$ are the maximum refractive index and the minimum refractive index of the $i^{th}$ region respectively, and $n_{max(i+1)}$ is the maximum refractive index of the $(i+1)^{th}$ region.

Preferably, the maximum refractive indices and the minimum refractive indices of any two adjacent ones of the regions satisfy: $n_{max(i)}-n_{min(i)}=n_{max(i+1})-n_{min(i+1)}$.

Preferably, the maximum refractive indices and the minimum refractive indices of any three adjacent ones of the regions satisfy: $n_{max(i+1)}-n_{min(i+2)}>n_{max(i)}-n_{min(i+1)}$.

Preferably, a refractive index distribution of the $i^{th}$ region satisfies:

$$n_i(\theta) = \frac{1}{c(\theta)}\left[\frac{(s+d)}{\cos\theta} - (s+d) + n_{min}d\right]$$

where $c(\theta)$ is an arc length of a generatrix of the curved surface to which the angle θ corresponds, s is the distance from the virtual focus to the man-made composite material, d is the thickness of the man-made composite material, and $n_{min}$ is the minimum refractive index of the man-made composite material.

Preferably, the generatrix of the curved surface is a parabolic arc.

Preferably, when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of a parabola where the parabolic arc is located is represented as:

$$y(x)=ax^2+bx+c$$

where a, b and c satisfy the following relationships:

$$c=(s+d)\tan\theta;$$

$$2ad+b=0$$

Preferably, the arc length $c(\theta)$ of the parabolic arc satisfies the following equation:

$$c(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right]$$

where δ is a preset decimal.

Preferably, the generatrix of the curved surface is an elliptical arc.

Preferably, when the line passing through the center of the second surface of the man-made composite material and perpendicular to the man-made composite material is taken as an abscissa axis and the line passing through the center of the second surface of the man-made composite material and parallel to the second surface is taken as an ordinate axis, an equation of an ellipse where the elliptical arc is located is represented as:

$$\frac{(x-d)^2}{a^2}+\frac{(y-c)^2}{b^2}=1$$

where a, b and c satisfy the following relationships:

$$\frac{d^2}{a^2}+\frac{[(s+d)\tan\theta-c]^2}{b^2}=1;$$

$$\frac{\sin\theta}{\sqrt{n^2(\theta)-\sin^2(\theta)}}=\frac{b^2}{a^2}\frac{d}{(s+d)\tan\theta-c}.$$

To achieve the aforesaid objective, the present invention further provides a man-made composite material antenna, which comprises a radiation source and a man-made composite material disposed in an electromagnetic wave propagation direction. The man-made composite material is divided into a plurality of regions. A plane electromagnetic wave is incident on a first surface of the man-made composite material and exits in the form of a spherical wave from a second surface of the man-made composite material opposite to the first surface. Reverse extensions of the exiting electromagnetic wave intersect with each other at a virtual focus of the man-made composite material. An intersection between an $i^{th}$ region and the first surface is a bottom surface of the $i^{th}$ region. An intersection between the $i^{th}$ region and the second surface is a top surface of the $i^{th}$ region. A line connecting the virtual focus to a point on the top surface of the $i^{th}$ region and a line perpendicular to the man-made composite material form an angle θ therebetween, which uniquely corresponds to a curved surface in the $i^{th}$ region. A set formed by points on the top surface of the $i^{th}$ region that have the same angle θ forms a boundary of the curved surface to which the angle θ uniquely corresponds. Each point on the curved surface to which the angle θ uniquely corresponds has a same refractive index. Refractive indices of each of the regions increase gradually as the angle θ increases.

Preferably, a line connecting the virtual focus to a point on an outer circumference of the top surface of the $i^{th}$ region and the line perpendicular to the man-made composite material form an angle θ, therebetween, i is a positive integer, and the closer the region is to a center of the man-made composite material, the smaller the value of i will be; wherein a generatrix of a curved surface to which the angle $\theta_i$ corresponds has an arc length $c(\theta_i)$, and the arc length $c(\theta_i)$ and the angle $\theta_i$ satisfy the following equations:

$$c(\theta_i)=\frac{\lambda}{n_{max(i)}-n_{min(i+1)}};$$

-continued $$(s+d)\times\left(\frac{1}{\cos\theta_i}-\frac{1}{\cos\theta_{i-1}}\right)=c(\theta_i)n_{max(i)}-c(\theta_{i-1})n_{min(i)}\Big),$$

where, $\theta_0=0$, $c(\theta_0)=d$; s is a distance from the virtual focus to the man-made composite material; d is a thickness of the man-made composite material; λ is a wavelength of an electromagnetic wave, $n_{max(i)}$ and $n_{min(i)}$ are the maximum refractive index and the minimum refractive index of the $i^{th}$ region respectively, and $n_{max(i+1)}$ is the maximum refractive index of the $(i+1)^{th}$ region.

Preferably, the maximum refractive indices and the minimum refractive indices of any two adjacent ones of the regions satisfy: $n_{max(i)}-n_{min(i)}=n_{max(i+1)}-n_{min(i+1)}$.

Preferably, the maximum refractive indices and the minimum refractive indices of any three adjacent ones of the regions satisfy: $n_{max(i+1)}-n_{min(i+2)}>n_{max(i)}-n_{min(i+1)}$.

Preferably, a refractive index distribution of the $i^{th}$ region satisfies:

$$n_i(\theta)=\frac{1}{c(\theta)}\left[\frac{(s+d)}{\cos\theta}-(s+d)+n_{min}d\right]$$

where $c(\theta)$ is an arc length of a generatrix of the curved surface to which the angle θ corresponds, s is the distance from the virtual focus to the man-made composite material, d is the thickness of the man-made composite material, and $n_{min}$ is the minimum refractive index of the man-made composite material.

Preferably, the generatrix of the curved surface is a parabolic arc.

Preferably, when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of a parabola where the parabolic are is located is represented as:

$$y(x)=ax^2+bx+c$$

where a, b and c satisfy the following relationships:

$$c=(s+d)\tan\theta;$$

$$2ad+b=0.$$

Preferably, the arc length $c(\theta)$ of the parabolic arc satisfies the following equation:

$$c(\theta)=\frac{d}{2}\left[\frac{\log\left(|\tan\theta|+\sqrt{1+\tan^2\theta}\right)+\delta}{|\tan\theta|+\delta}+\sqrt{1+\tan^2\theta}\right]$$

where δ is a preset decimal.

Preferably, the generatrix of the curved surface is an elliptical arc.

Preferably, when the line passing through the center of the second surface of the man-made composite material and perpendicular to the man-made composite material is taken as an abscissa axis and the line passing through the center of the second surface of the man-made composite material and parallel to the second surface is taken as an ordinate axis, an equation of an ellipse where the elliptical arc is located is represented as:

$$\frac{(x-d)^2}{a^2}+\frac{(y-c)^2}{b^2}=1;$$

where a, b and c satisfy the following relationships:

$$\frac{d^2}{a^2}+\frac{[(s+d)\tan\theta-c]^2}{b^2}=1;$$

$$\frac{\sin\theta}{\sqrt{n^2(\theta)-\sin^2(\theta)}}=\frac{b^2}{a^2}\frac{d}{(s+d)\tan\theta-c}.$$

The technical solutions of the present invention have the following benefits: by designing abrupt transitions of the refractive indices of the man-made composite material to follow a curved surface whose generatrix is an arc, the refraction, diffraction and reflection at the abrupt transition points can be significantly reduced. As a result, the problems caused by interferences are eased, which makes performances of the man-made composite material and the man-made composite material antenna more superior.

BRIEF DESCRIPTION OF THE DRAWINGS

Hereinbelow, the present invention will be further described with reference to the attached drawings and embodiments thereof. In the attached drawings.

DETAILED DESCRIPTION OF THE INVENTION

Figure 1:
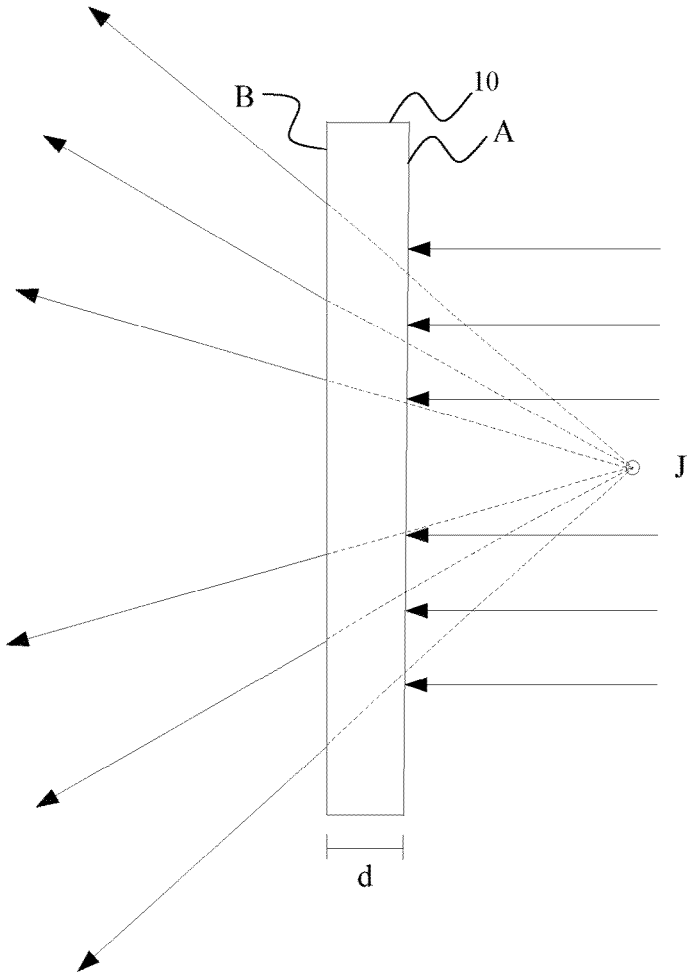
FIG. 1 is a schematic view illustrating a diverging effect of a man-made composite material according to an embodiment of the present invention on an electromagnetic wave.

FIG. 1 is a schematic view illustrating a diverging effect or a man-made composite material 10 according to an embodiment of the present invention on an electromagnetic wave. The man-made composite material 10 is disposed in an electromagnetic wave propagation direction of a radiation source. A plane electromagnetic wave is incident on a first surface A of the man-made composite material and exits in the form of a spherical wave from a second surface B of the man-made composite material opposite to the first surface A. Reverse extensions of the exiting electromagnetic wave intersect with each other at a virtual focus J of the man-made composite material.

When an electromagnetic wave propagates from a medium to another medium, the electromagnetic wave will be refracted; and if the refractive index distribution in the material is non-uniform, then the electromagnetic wave will be deflected towards a site having a larger refractive index. As can be known as a common sense, the refractive index of the electromagnetic wave is proportional to $\sqrt{\epsilon\times\mu}$. By designing electromagnetic parameters of the man-made composite material at each point, the refractive index distribution of the man-made composite material can be adjusted so as to achieve the purpose of changing the propagating path of the electromagnetic wave.

Figure 2:
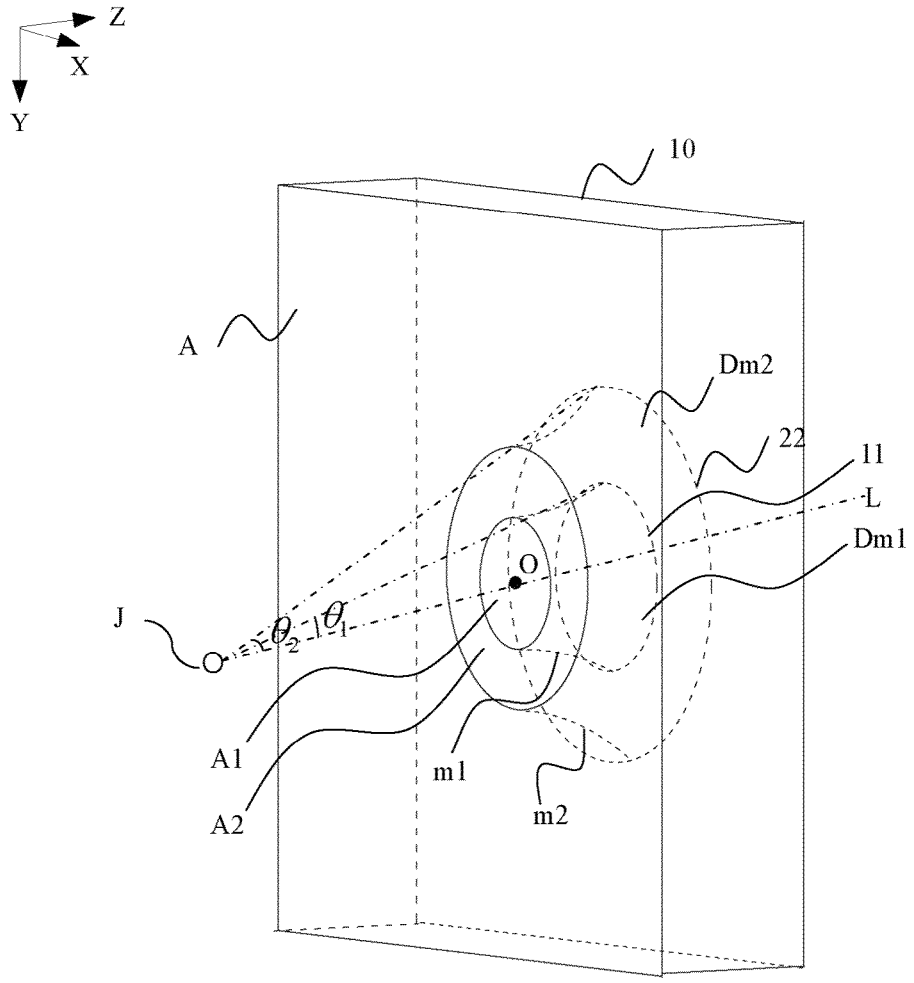
FIG. 2 is a schematic structural view of the man-made composite material shown in FIG. 1.

FIG. 2 is a schematic structural view of the man-made composite material 10 shown in FIG. 1. The man-made composite material 10 is divided into a plurality of regions. An intersection between an $i^{th}$ region and the first surface A is a bottom surface of the $i^{th}$ region, and an intersection between the $P^i$ region and the second surface B is a top surface of the $i^{th}$ region. A line connecting the virtual focus J to a point on the top surface of the $i^{th}$ region and a line L perpendicular to the man-made composite material form an angle θ therebetween, which uniquely corresponds to a curved surface in the $i^{th}$ region. A set formed by points on the top surface of the $i^{th}$ region that have the same angle θ forms a boundary of the curved surface to which the angle θ uniquely corresponds. Each point on the curved surface to which the angle θ uniquely corresponds has a same refractive index. Refractive indices of each of the regions increase gradually as the angle θ increases. FIG. 2 shows two regions (the regions herein are three-dimensional, and are shown as two annular bodies in FIG. 3). The reuions introduced herein are divided only for purpose of better describing the refractive index distribution of the man-made composite material, and are not actual entities. A curved surface of the outermost boundary of the first region (represented as 101 in FIG. 3) corresponds to an angle $\theta_1$, and a curved surface of the outermost boundary of the second region (represented as 102 in FIG. 3) corresponds to an angle $\theta_2$. A set formed by points on the top surface of the first region that have the angle $\theta_1$ forms a boundary (shown as a circumference 11) of the curved surface Dml to which the angle $\theta_1$ uniquely corresponds. A set formed by points on the top surface of the second region that have the angle $\theta_2$ forms a boundary (shown as a circumference 22) of the curved surface Dm2 to which the angle $\theta_2$ uniquely corresponds. This will be detailed in the following description.

Figure 3:
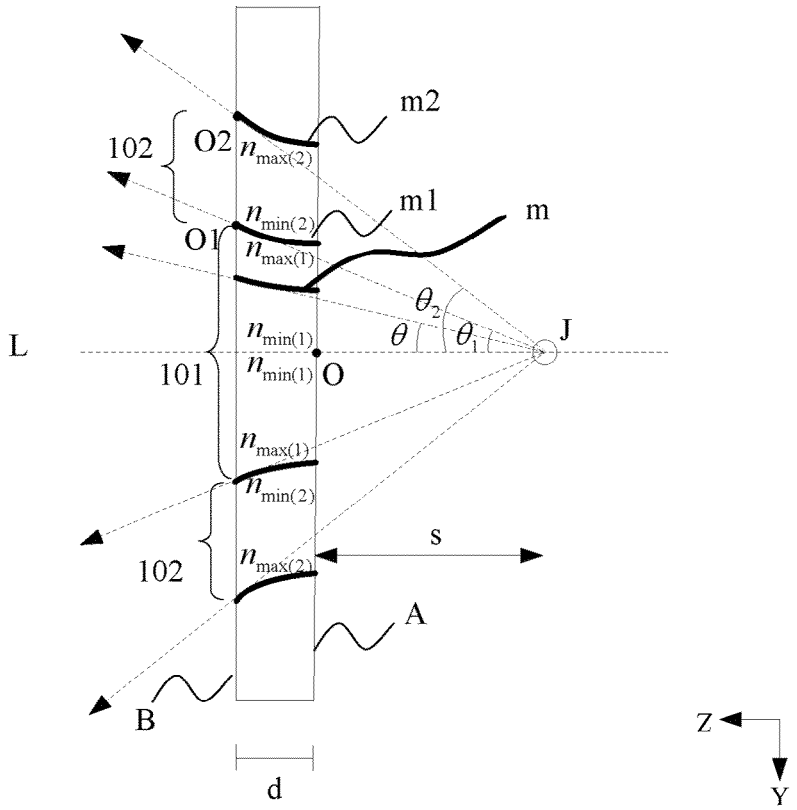
FIG. 3 is a side view of the man-made composite material shown in FIG. 2.

FIG. 3 is a side view of the man-made composite material 10. Two regions are shown in this side view only for purpose of illustration rather than to limit the present invention. A side cross-sectional view of a curved surface having a same refractive index is in the form of two arcs, which are symmetrical with respect to L. The thickness of the man-made composite material 10 is as shown by d, and L represents a line perpendicular to the man-made composite material. As can be known from FIG. 4, each of the regions is an arc in a side view, and refractive indices on a same arc are identical to each other; that is, a curved surface formed by the arc when being rotated about the line L has the same refractive index at each point of the curved surface. In order to more clearly describe that refractive indices on a same curved surface are identical to each other, a virtual curved surface (which does not exist actually, and is elucidated only for convenience of description) in the man-made composite material will be elucidated.

Assume that a line connecting the virtual focus J to a point on an outer circumference of the top surface of the $i^{th}$ region and the line L perpendicular to the man-made composite material form an angle $\theta_i$ therebetween, i is a positive integer, and the closer the region is to a center O of the man-made composite material 10, the smaller the value of i will be. A generatrix of a curved surface to which the angle $\theta_i$ corresponds has an arc length $c(\theta_i)$, and the arc length $c(\theta_i)$ and the angle $\theta_i$ satisfy the following equations:

$$c(\theta_i) = \frac{\lambda}{n_{max(i)} - n_{min(i+1)}};$$

$$(s+d)\times\left(\frac{1}{\cos\theta_i} - \frac{1}{\cos\theta_{i-1}}\right) = c(\theta_i)n_{max(i)} - c(\theta_{i-1})n_{min(i)}\Big),$$

where, $\theta_0=0$, $c(\theta_0)=d$; s is a distance from the virtual focus J to the man-made composite material 10; d is the thickness of the man-made composite material 10; $\lambda$ is a wavelength of an electromagnetic wave, $n_{max(i)}$ and $n_{(min(i)}$ are the maximum refractive index and the minimum refractive index of the $i^{th}$ region respectively, and $n_{max(i+1)}$ and $n_{min(i+1)}$ are the maximum refractive index and the minimum refractive index of the $(i+1)^{th}$ region. The angle $\theta$ or $\theta_i$ ranges between $$[0, \frac{\pi}{2}).$$

The maximum refractive indices and the minimum refractive indices of any two adjacent ones of the regions satisfy: $n_{max(i)}-n_{min(i)}=n_{max(i+1)}-n_{min(i+1)}$.

As shown in FIG. 2 and FIG. 3, the two regions 101 and 102 are shown therein. $\theta_1$ represents an angle formed between a line connecting the virtual locus J to a point on an outer circumference of the top surface of the first region 101 and the line L perpendicular to the man-made composite material 10, and $\theta_2$ represents an angle formed between a line connecting the virtual focus J to a point on an outer circumference of the bottom surface of the second region 102 and the line L perpendicular to the man-made composite material 10. Supposing that $n_{max(1)}$ and $n_{min(1)}$ are already known, the angle $\theta_1$ and the minimum refractive index $n_{min(2)}$ of the first region can be obtained through the following equations:

$$c(\theta_1) = \frac{\lambda}{n_{max(1)} - n_{min(2)}};$$

$$(s+d)\times\left(\frac{1}{\cos\theta_1} - 1\right) = c(\theta_1)n_{max(1)} - c(\theta_0)n_{min(1)}\Big).$$

The angle $\theta_2$ and the minimum refractive index $n_{min(3)}$ of the second region can be obtained through the following equations:

$$c(\theta_2) = \frac{\lambda}{n_{max(2)} - n_{min(3)}};$$

$$(s+d)\times\left(\frac{1}{\cos\theta_2} - \frac{1}{\cos\theta_1}\right) = c(\theta_2)n_{max(2)} - c(\theta_1)n_{min(2)}\Big).$$

In an embodiment of the present invention, the maximum refractive indices and the minimum refractive indices of any three adjacent ones of the regions satisfy:

$$n_{max(i+1)}-n_{min(i+2)}>n_{max(i)}-n_{min(i+1)}.$$

As shown in FIG. 3, a generatrix of a curved surface of the outermost boundary of each of the regions is an arc. The arc shown in the side view is just the generatrix of the curved surface of the outermost boundary of each of the regions. For each of the regions, a curved surface of an inner boundary has the minimum refractive index and a curved surface of an outer boundary has the maximum refractive index.

As shown in FIG. 2 and FIG. 3, a line connecting the virtual focus J to a point O1 on the outer circumference of the top surface A1 of the first region 101 and the line L form an angle $\theta_1$ therebetween, a curved surface Dm1 of the outermost boundary of the first region 101 has a generatrix m1, the arc m1 has an arc length $c(\theta_1)$, and the curved surface formed by the arc m1 when being rotated about the line L is Dm1. A line connecting the virtual focus J to a point O2 on the outer circumference of the top surface A2 of the second region 102 and the line L form an angle $\theta_2$ therebetween, a curved surface Dm2 of the outermost boundary of the second region 102 has a generatrix m2, the arc m2 has an arc length $c(\theta_2)$, and the curved surface formed by the arc m2 when being rotated about the line L is Dm2. As shown in FIG. 3, the arcs m1 and m2 arc distributed symmetrically with respect to the line L. Refractive index distributions on the curved surfaces Dm1 are identical to each other. Refractive index distributions on the curved surfaces Dm2 are identical to each other.

For any of the regions, supposing that a line connecting the virtual focus J to a point on the top surface of the $i^{th}$ region and the line L perpendicular to the man-made composite material form an angle $\theta$ therebetween, then the rule of refractive indices $n_i(\theta)$ of the $i^{th}$ region varying with the angle $\theta$ satisfies:

$$n_i(\theta) = \frac{1}{c(\theta)}\left[\frac{(s+d)}{\cos\theta} - (s+d) + n_{min}d\right]$$

where $c(\theta)$ is an arc length of a generatrix of the curved surface to which the angle $\theta$ corresponds, s is the distance from the virtual focus J to the man-made composite material 10, d is the thickness of the man-made composite material, and $n_{min}$ is the minimum refractive index of the man-made composite material. The angle $\theta$ ranges between $$[0, \frac{\pi}{2}).$$

In FIG. 3, as an example, the angle $\theta$ uniquely corresponds to a curved surface in the first region 101, and the curved surface has a generatrix m.

Hereinbelow, a case in which the arc m is a parabolic arc and a case in which the arc m is an elliptical arc will be respectively illustrated as an example.

Supposing that the arc m is a parabolic arc, the arc length $c(\theta)$ satisfies the following equation:

$$c(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right]$$

where $\delta$ is a preset decimal. $\delta$ is a preset decimal (e.g., 0.0001), and can ensure that the ratio $$\frac{\log\left(|\tan\theta| + \sqrt{1+\tan^2\theta}\right) + \delta}{|\tan\theta| + \delta}$$

converges when the angle $\theta$ approaches to 0. The angle $\theta$ ranges between $$[0, \frac{\pi}{2}).$$

Figure 4:
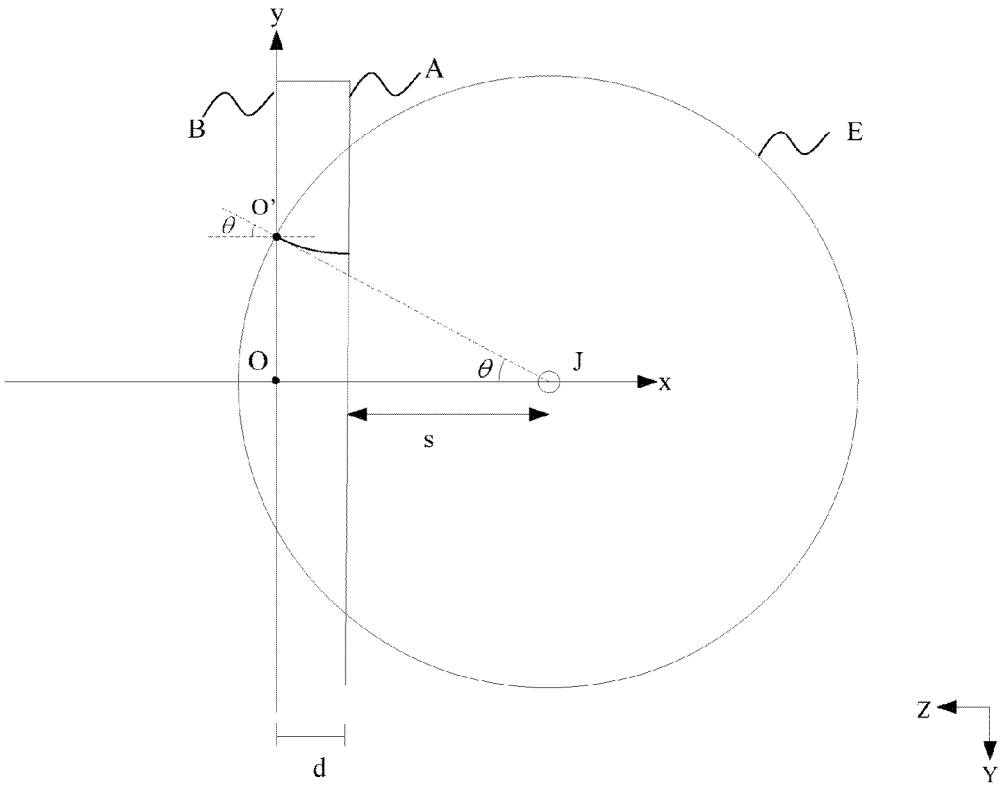
FIG. 4 is a schematic view illustrating relationships between an arc m shown in FIG. 3 and an angle θ when the arc m is a parabolic arc.

As shown in FIG. 4, when a line passing through a center O of the second surface B of the man-made composite material 10 and perpendicular to the man-made composite material 10 is taken as an abscissa axis and a line passing through the center O of the second surface B of the man-made composite material 10 and parallel to the second surface B is taken as an ordinate axis, a line connecting the virtual focus J to a certain point O' on the surface B and the X axis form an angle θ therebetween.

Suppose that an equation of a parabola where the parabolic arc m shown by a solid line on the parabola is located is: $y(x)=ax^2+bx+c$. The parabola passes through a point (0, (s+d) tan θ); i.e., y(0)=c=(s+d)tan θ. In order to make the electromagnetic wave propagate in a direction of the designed parabola, a tangent line of the parabolic arc must be parallel with the X axis when the electromagnetic wave propagates through the first surface A of the man-made composite material; i.e., it must be ensured that y'(d)=0. Because y'(x)=2ax+b, y'(d)=2ad+b=0. In addition, it must also be ensured that the electromagnetic wave propagates in a tangent direction corresponding to the angle θ when reaching the second surface B of the man-made composite material, so y'(0)=tan θ. An exit direction of the electromagnetic wave at any point O' on the surface B is a direction of a radius JO' in a sphere E with the virtual focus J as a circle center, i.e., a direction perpendicular to a surface of the sphere E. It can be derived from the aforesaid conditions that the equation of the parabola is $$y(x) = \tan\theta\left(-\frac{1}{2d}x^2 + x + s + d\right).$$

Thereby, a relational expression between the angle θ and each point (x, y) on the parabolic arc m is obtained as $$\theta(x, y) = \tan^{-1}\left[\frac{2dy}{2d(s+d+x)-x^2}\right].$$

The angle θ uniquely corresponds to a curved surface in the man-made composite material, which is obtained through rotation of the generatrix m about the line L (the X axis); and each point on the curved surface to which the angle θ uniquely corresponds has a same refractive index.

Figure 5:
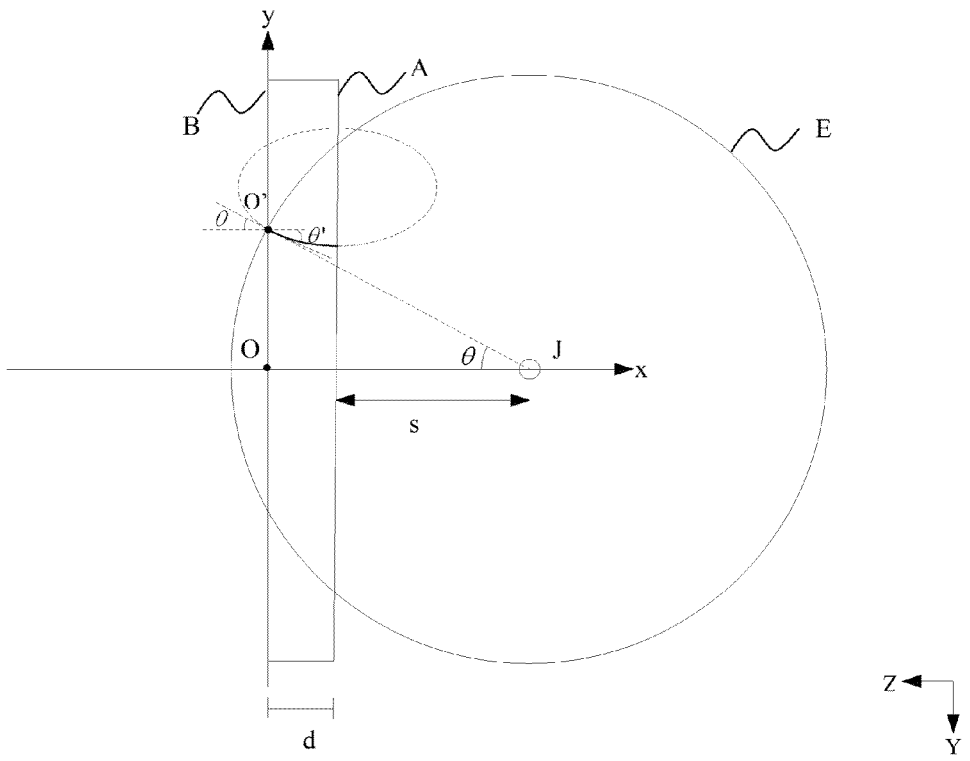
FIG. 5 is a schematic view illustrating relationships between the arc m shown in FIG. 3 and the angle θ when the arc m is an elliptical arc.

Suppose that the arc m is an elliptical arc. As shown in FIG. 5, when the line passing through the center O of the second surface B of the man-made composite material 10 and perpendicular to the man-made composite material 10 is taken as an abscissa axis and the line passing through the center O of the second surface B of the man-made composite material 10 and parallel to the second surface B is taken as an ordinate axis, a line connecting the virtual focus J to a point O' on the surface R and the X axis form art angle θ therebetween.

An equation of an ellipse where the elliptical arc m shown by a solid line on the ellipse is located is:

$$\frac{(x-d)^2}{a^2} + \frac{(y-c)^2}{b^2} = 1.$$

A center of the ellipse is located on the first surface A, and has coordinates of (d, c). The ellipse passes through a point (0, (s+d)tan θ); i.e., y(0)=(s+d)tan θ. Through the equation of the ellipse, it can be obtained that $$\frac{d^2}{a^2} + \frac{[(s+d)\tan\theta - c]^2}{b^2} = 1.$$

When a plane wave is incident on the man-made composite material, a tangent line of the electromagnetic wave on the elliptical arc of the first surface A of the man-made composite material must be parallel with the X axis; i.e., it must be ensured that y'(d)=0. A tangential equation at any point (x, y) on the ellipse is $$\frac{dy}{dx} = -\frac{b^2}{a^2}\frac{x-d}{y-c},$$

so it can be obtained that y'(d)=0. An exit direction of the electromagnetic wave at any point O' on the surface B is a direction of a radius JO' in a sphere E with the virtual focus J as a circle center, i.e., a direction perpendicular to a surface of the sphere E.

The point O' on the second surface B corresponding to the angle θ has a refraction angle θ' and a refractive index n(θ); and it can be known from the Snell's law that $$n(\theta) = \frac{\sin\theta}{\sin\theta'}.$$

Figure 6:
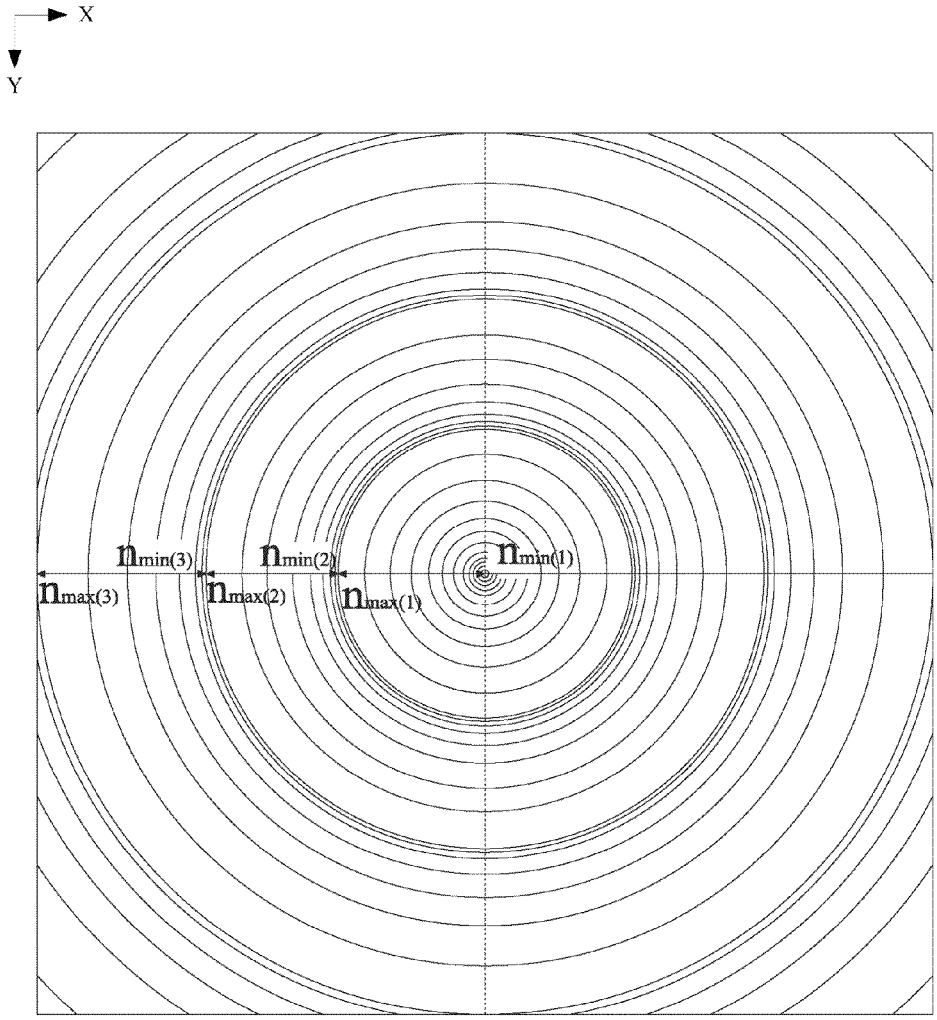
FIG. 6 is a diagram illustrating a refractive index distribution of the man-made composite material in a YX plane.

The electromagnetic wave propagates in a tangent direction corresponding to the refraction angle θ' when reaching the second surface B of the man-made composite material 10 from the external (as shown in FIG. 6). That is, at a point where the elliptical arc m infinitely approaches to 0', $y(0^+)=\tan\theta'$. Thereby, the following relational expressions can be obtained:

$$y'(0^+) = \tan\theta' = \frac{\sin\theta}{\sqrt{n^2(\theta) = \sin^2(\theta)}} = \frac{b^2}{a^2}\frac{d}{(s+d)\tan\theta - c};$$

$$\frac{\sin\theta}{\sqrt{n^2(\theta) - \sin^2(\theta)}} = \frac{b^2}{a^2}\frac{d}{(s+d)\tan\theta - c}.$$

The angle θ uniquely corresponds to a curved surface in the man-made composite material, which is obtained through rotation of the generatrix m about the line L (the X axis); and each point on the curved surface to which the angle θ uniquely corresponds has a same refractive index.

It shall be appreciated that, when a=b in the ellipse, the ellipse becomes a true circle; and in this case, the corresponding elliptical arc becomes a circular arc, and the curved surface is formed through rotation of the circular arc about the line L (the X axis).

The man-made composite material can be used to convert a plane wave radiated from the radiation source into a spherical wave. Refractive indices of the man-made composite material increase from $n_{min(i)}$ to $n_{max(i)}$ as the angle θ increases, as shown in FIG. 5. A segment of the elliptical arc shown by a solid line on the ellipse is a generatrix of a virtual curved surface, and refractive indices on a same curved surface are identical to each other. It shall be appreciated that, the man-made composite material of the present invention may also be used to convert a spherical wave into a plane wave (i.e., a case reversed from what is shown in FIG. 1) without the need of changing the construction of the man-made composite material. Therefore, various applications adopting the principle of the present invention shall all fall within the scope of the present invention.

In actual structure designs, the man-made composite material may be designed to be formed by a plurality of man-made composite material sheet layers, each of which comprises a sheet substrate and a plurality of man-made microstructures or man-made pore structures attached on the substrate. The overall refractive index distribution of the plurality of man-made composite material sheet layers combined together must satisfy or approximately satisfy the aforesaid equations so that refractive indices on a same curved surface are identical to each other, and the generatrix of the curved surface is designed as a parabolic arc or an elliptical arc. Of course, in actual designs, it may be relatively difficult to design the generatrix of the curved surface as an accurate parabolic arc or an accurate elliptical arc, so the generatrix of the curved surface may be designed as an approximate parabolic arc, an approximate elliptical arc or a stepped form as needed and degrees of accuracy may be chosen as needed. With continuous advancement of the technologies, the designing manners are also updated continuously, and there may be a better designing process for the man-made composite material to achieve the refractive index distribution provided by the present invention.

Each of the man-made microstructures is a two-dimensional (2D) or three-dimensional (3D) structure consisting of a metal wire and having a geometric pattern, and may be of, for example but is not limited to, a "cross" shape, a 2D snowflake shape or a 3D snowflake shape. The metal wire may be a copper wire or a silver wire, and may be attached on the substrate through etching, electroplating, drilling, photolithography, electron etching or ion etching. The plurality of man-made microstructures in the man-made composite material make refractive indices of the metamaterial increase with the angle θ. Given that an incident electromagnetic wave is known, by appropriately designing topology patterns of the man-made microstructures and designing arrangement of the man-made microstructures of different dimensions within an electromagnetic wave converging component, the refractive index distribution of the man-made composite material can be adjusted to convert the plane electromagnetic wave into an electromagnetic wave diverging in the form of a spherical wave.

In order to more intuitively represent the refractive index distribution of each of the man-made composite material sheet layers in a YX plane, the units that have the same refractive index are connected to form a line, and the magnitude of the refractive index is represented by the density of the lines. A larger density of the lines represents a larger refractive index. The refractive index distribution of the metamaterial satisfying all of the above relational expressions is as shown in FIG. 6.

The present invention further provides a man-made composite material antenna. Apart from the man-made composite material 10 shown in FIG. 1 or FIG. 2, the man-made composite material antenna further comprises a radiation source disposed at a side of the man-made composite material 10. The structure and the refractive index variations of the man-made composite material 10 have been described above, and thus will not be further described herein.

The aforesaid man-made composite material may be in the form shown in FIG. 2, and of course, may also be made into other desired forms such as an annular form so long as the aforesaid refractive index variation rules can be satisfied.

In actual applications, in order to achieve better performances of the man-made composite material and reduce the reflection, an impedance matching layer may be disposed at each of two sides of the man-made composite material. Details of the impedance matching layer can be found in the prior art documents, and thus will not be further described herein.

By designing abrupt transitions oldie refractive indices of the man-made composite material to follow a curved surface whose generatrix is an arc according to the present invention, the refraction, diffraction and reflection at the abrupt transition points can be significantly reduced. As a result, the problems caused by interferences are eased, which makes performances of the man-made composite material more superior.

The embodiments of the present invention have been described above with reference to the attached drawings; however, the present invention is not limited to the aforesaid embodiments, and these embodiments are only illustrative but are not intended to limit the present invention. Those of ordinary skill in the art may further devise many other implementations according to the teachings of the present invention without departing from the spirits and the scope claimed in the claims of the present invention, and all of the implementations shall fall within the scope of the present invention.

What is claimed is:

1. A man-made composite material having a thickness between a first and second surface, configured such that the first and second surfaces are perpendicularly disposed to a propagation direction of a plane electromagnetic wave, wherein the man-made composite material is divided into a plurality of regions; the plane electromagnetic wave is incident on the first surface of the man-made composite material and a spherical electromagnetic wave exits from the second surface of the man-made composite material opposite to the first surface;

reverse extensions of the exiting spherical electromagnetic wave intersect with each other at a virtual focus of the man-made composite material; an $i^{th}$ region is one of the plurality of regions, where i is a positive integer and selected from a group consisting of 1, 2, 3, . . . , etc.;

an intersection between the $i^{th}$ region and the first surface is a bottom surface of the $i^{th}$ region, an intersection between the $i^{th}$ region and the second surface is a top surface of the $i^{th}$ region, and each $i^{th}$ region has a curved surface extending from the top surface to the bottom surface;

each $i^{th}$ region having a set of first straight lines connecting the virtual focus to a corresponding set of points on a circular boundary line between the $i^{th}$ region's curved surface and the $i^{th}$ region's top surface, and a second straight line perpendicular to the man-made composite material, wherein each first straight line forms an angle θ with the second straight line, wherein the same angle θ corresponds to each of the points in the set of points;

each $i^{th}$ region having additional sets of first straight lines connecting the virtual focus to additional corresponding sets of points along the $i^{th}$ region's curved surface, wherein each additional set of points on the $i^{th}$ region's curved surface form a circular line and has a same uniquely corresponding angle θ and a same refractive index; each $i^{th}$ region's curved surface has a generatrix which extends between the bottom surface and the top surface of the $i^{th}$ region and is formed by rotating the generatrix about the second straight line; and refractive indices of each of the regions increase gradually as the angle θ increases.

2. The man-made composite material of claim 1, wherein a line connecting the virtual focus to a point on an outer circumference of the top surface of the $i^{th}$ region and the line perpendicular to the man-made composite material form an angle $\theta_i$ therebetween, i is a positive integer, and the closer the region is to a center of the man-made composite material, the smaller the value of i will be; wherein a generatrix of a curved surface to which the angle $\theta_i$ corresponds has an arc length $c(\theta_i)$ and the arc length $c(\theta_i)$ and the angle $\theta_i$ satisfy the following equations:

$$c(\theta_i) = \frac{\lambda}{n_{max(i)} - n_{min(i+1)}};$$

$$(s+d)\times\left(\frac{1}{\cos\theta_i} - \frac{1}{\cos\theta_{i-1}}\right) = c(\theta_i)n_{max(i)} - c(\theta_{i-1})n_{min(i)}),$$

where, $\theta_0=0$, $c(\theta_0)=d$ ; s is a distance from the virtual focus to the man-made composite material; d is a thickness of the man-made composite material; λ is a wavelength of an electromagnetic wave, $n_{max(i)}$ and $n_{min(i)}$ are the maximum refractive index and the minimum refractive index of the $i^{th}$ region respectively, and $n_{max(i+1)}$ is the maximum refractive index of the $(i+1)^{th}$ region.

3. The man-made composite material of claim 2, wherein the maximum refractive indices and the minimum refractive indices of any two adjacent ones of the regions satisfy: $n_{max(i)}-n_{min(i)}=n_{max(i+1)}-n_{min(i+1)}$.

4. The man-made composite material of claim 3, wherein the maximum refractive indices and the minimum refractive indices of any three adjacent ones of the regions satisfy: $n_{max(i+1)}-n_{min(i+2)}>n_{max(i)}-n_{min(i+1)}$.

5. The man-made composite material of claim 2, wherein a refractive index distribution of the $i^{th}$ region satisfies:

$$n_i(\theta) = \frac{1}{c(\theta)}\left[\frac{(s+d)}{\cos\theta} - (s+d) + n_{min}d\right]$$

where $c(\theta)$ is an arc length of a generatrix of the curved surface to which the angle θ corresponds, s is the distance from the virtual focus to the man-made composite material, d is the thickness of the man-made composite material, and $n_{min}$ is the minimum refractive index of the man-made composite material.

6. The man-made composite material of claim 1, wherein the generatrix of the curved surface is a parabolic arc.

7. The man-made composite material of claim 6, wherein when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of a parabola where the parabolic arc is located is represented as:

$$y(x)=ax^2+bx+c$$

where a, b and c satisfy the following relationships:

$$c=(s+d)\tan\theta;$$

$$2ad+b=0.$$

8. The man-made composite material of claim 7, wherein the arc length $c(\theta)$ of the parabolic arc satisfies the following equation:

$$c(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right]$$

where δ is a preset decimal.

9. The man-made composite material of claim 1, wherein the generatrix of the curved surface is an elliptical arc.

10. The man-made composite material of claim 9, wherein when the line passing through the center of the second surface of the man-made composite material and perpendicular to the man-made composite material is taken as an abscissa axis and the line passing through the center of the second surface of the man-made composite material and parallel to the second surface is taken as an ordinate axis, an equation of an ellipse where the elliptical arc is located is represented as:

$$\frac{(x-d)^2}{a^2} + \frac{(y-c)^2}{b^2} = 1$$

where a, b and c satisfy the following relationships:

$$\frac{d^2}{a^2} + \frac{[(s+d)\tan\theta - c]^2}{b^2} = 1;$$

$$\frac{\sin\theta}{\sqrt{n^2(\theta) - \sin^2(\theta)}} = \frac{b^2}{a^2}\frac{d}{(s+d)\tan\theta - c}.$$

11. A man-made composite material antenna, comprising a radiation source and a man-made composite material, the man-made composite material having a thickness between a first and second surface, configured such that the first and second surfaces are perpendicularly disposed to a propagation direction of a plane electromagnetic wave, wherein the man-made composite material is divided into a plurality of regions; the plane electromagnetic wave is incident on the first surface of the man-made composite material and a spherical electromagnetic wave exits from the second surface of the man-made composite material opposite to the first surface; reverse extensions of the exiting spherical electromagnetic wave intersect with each other at a virtual focus of the man-made composite material; an $i^{th}$ region is one of the plurality of regions, where i is a positive integer and selected from a group consisting of 1, 2, 3, . . . , etc.;

an intersection between a the $i^{th}$ region and the first surface is a bottom surface of the $i^{th}$ region, an intersection between the $i^{th}$ region and the second surface is a top surface of the $i^{th}$ region, and each $i^{th}$ region has a curved surface extending from the top surface to the bottom surface;

each $i^{th}$ region having a set of first straight lines connecting the virtual focus to a corresponding set of points on a circular boundary line between the $i^{th}$ region's curved surface and the $i^{th}$ region's top surface, and a second straight line perpendicular to the man-made composite material, wherein each first straight line forms an angle θ with the second straight line, wherein the same angle θ corresponds to each of the points in the set of points;

each $i^{th}$ region having additional sets of first straight lines connecting the virtual focus to additional corresponding sets of points along the $i^{th}$ region's curved surface, wherein each additional set of points on the $i^{th}$ region's curved surface form a circular line and has a same uniquely corresponding angle θ and a same refractive index; each $i^{th}$ region's curved surface has a generatrix which extends between the bottom surface and the top surface of the $i^{th}$ region and is formed by rotating the generatrix about the second straight line; and refractive indices of each of the regions increase gradually as the angle θ increases.

12. The man-made composite material antenna of claim 11, wherein a line connecting the virtual focus to a point on an outer circumference of the top surface of the $i^{th}$ region and the line perpendicular to the man-made composite material form an angle $\theta_i$ therebetween, i is a positive integer, and the closer the region is to a center of the man-made composite material, the smaller the value of i will be; wherein a generatrix of a curved surface to which the angle $\theta_i$ corresponds has an arc length $c(\theta_i)$, and the arc length $c(\theta_i)$ and the angle $\theta_i$ satisfy the following equations:

$$c(\theta_i) = \frac{\lambda}{n_{max(i)} - n_{min(i+1)}};$$

$$(s+d)\times\left(\frac{1}{\cos\theta_i} - \frac{1}{\cos\theta_{i-1}}\right) = c(\theta_i)n_{max(i)} - c(\theta_{i-1})n_{min(i)}),$$

where, $\theta_0=0$, $c(\theta_0)=d$; s is a distance from the virtual focus to the man-made composite material; d is a thickness of the man-made composite material; λ is a wavelength of an electromagnetic wave, $n_{max(i)}$ and $n_{min(i)}$ are maximum refractive index and the minimum refractive index of the $i^{th}$ region respectively, and $n_{max(i+1)}$ is the maximum refractive index of the $(i+1)^{th}$ region.

13. The man-made composite material antenna of claim 12, wherein the maximum refractive indices and the minimum refractive indices of any two adjacent ones of the regions satisfy:

$$n_{max(i)}-n_{min(i)}=n_{max(i+1)}-n_{min(i+1)}.$$

14. The man-made composite material antenna of claim 13, wherein the maximum refractive indices and the minimum refractive indices of any three adjacent ones of the regions satisfy:

$$n_{max(i+1)}-n_{min(i+2)}>n_{max(i)}-n_{min(i+1)}.$$

15. The man-made composite material antenna of claim 12, wherein a refractive index distribution of the $i^{th}$ region satisfies:

$$n_i(\theta) = \frac{1}{c(\theta)}\left[\frac{(s+d)}{\cos\theta} - (s+d) + n_{min}d\right]$$

where $c(\theta)$ is an arc length of a generatrix of the curved surface to which the angle θ corresponds, s is the distance from the virtual focus to the man-made composite material, d is the thickness of the man-made composite material, and $n_{min}$ is the minimum refractive index of the man-made composite material.

16. The man-made composite material antenna of claim 11, wherein the generatrix of the curved surface is a parabolic arc.

17. The man-made composite material antenna of claim 16, wherein when a line passing through a center of the second surface of the man-made composite material and perpendicular to the man-made composite material is taken as an abscissa axis and a line passing through the center of the second surface of the man-made composite material and parallel to the second surface is taken as an ordinate axis, an equation of a parabola where the parabolic arc is located is represented as:

$$y(x)=ax^2+bx+c$$

where a, b and c satisfy the following relationships:

$$c=(s+d)\tan\theta;$$

$$2ad+b=0.$$

18. The man-made composite material antenna of claim 17, wherein the arc length $c(\theta)$ of the parabolic arc satisfies the following equation:

$$c(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right]$$

where δ is a preset decimal.

19. The man-made composite material antenna of claim 11, wherein the generatrix of the curved surface is an elliptical arc.

20. The man-made composite material antenna of claim 19, wherein when the line passing through the center of the second surface of the man-made composite material and perpendicular to the man-made composite material is taken as an abscissa axis and the line passing through the center of the second surface of the man-made composite material and parallel to the second surface is taken as an ordinate axis, an equation of an ellipse where the elliptical arc is located is represented as:

$$\frac{(x-d)^2}{a^2} + \frac{(y-c)^2}{b^2} = 1$$

where a, b and c satisfy the following relationships:

$$\frac{d^2}{a^2} + \frac{[(s+d)\tan\theta - c]^2}{b^2} = 1;$$

$$\frac{\sin\theta}{\sqrt{n^2(\theta) - \sin^2(\theta)}} = \frac{b^2}{a^2}\frac{d}{(s+d)\tan\theta - c}.$$

* * * * *